US007650723B1

(12) United States Patent
Kotlarich

(10) Patent No.: US 7,650,723 B1
(45) Date of Patent: Jan. 26, 2010

(54) CONCEALED EMERGENCY ATTIC EGRESS SYSTEM

(76) Inventor: Paul Kotlarich, 1450 Montrose, Beaumont, TX (US) 77707

( * ) Notice: Subject to any disclaimer, the term of this patent is extended or adjusted under 35 U.S.C. 154(b) by 519 days.

(21) Appl. No.: 11/243,847

(22) Filed: Oct. 5, 2005

(51) Int. Cl.
*E06B 3/26* (2006.01)
*E06B 1/04* (2006.01)
*E05B 65/10* (2006.01)

(52) U.S. Cl. ..... 52/202; 52/213; 52/19; 49/141

(58) Field of Classification Search ..... 52/205, 52/213, 199, 200, 19, 745.15, 745.16, 202, 52/203, 656.1, 656.2, 656.3; 49/141
See application file for complete search history.

(56) References Cited

U.S. PATENT DOCUMENTS 1,325,794 A * 12/1919 Lichty ..... 52/199
1,740,749 A * 12/1929 Shuman ..... 52/518
2,066,705 A * 1/1937 Vazquez ..... 70/118
2,199,590 A * 5/1940 Groth ..... 52/213
3,046,615 A * 7/1962 Sherron ..... 49/386
3,120,032 A * 2/1964 Burnette ..... 49/395
3,621,610 A * 11/1971 Edwards ..... 446/470
3,861,083 A * 1/1975 Goiot ..... 49/193
4,021,073 A * 5/1977 Manning ..... 296/223
4,106,236 A * 8/1978 Oliphant ..... 49/141
4,468,886 A * 9/1984 Tew ..... 49/141
4,532,915 A * 8/1985 de Rham ..... 126/242
4,663,905 A * 5/1987 Schulz ..... 52/202
4,860,511 A * 8/1989 Weisner et al. ..... 52/200
4,986,039 A * 1/1991 Weisner ..... 52/72
5,103,591 A * 4/1992 Szymanski ..... 49/379
5,137,327 A * 8/1992 Edmonds et al. ..... 296/224
5,487,243 A * 1/1996 Hale et al. ..... 52/202
D374,486 S * 10/1996 Guin ..... D25/48
5,746,033 A * 5/1998 Chuang ..... 52/213
5,813,797 A * 9/1998 Pendleton et al. ..... 405/52
5,881,510 A * 3/1999 Ole ..... 52/217
6,151,838 A * 11/2000 Husein ..... 52/58

(Continued)

FOREIGN PATENT DOCUMENTS

GB 2256890 * 12/1992

*Primary Examiner*—Richard E Chilcot, Jr.
*Assistant Examiner*—Brent W Herring
(74) *Attorney, Agent, or Firm*—Browning Bushman P.C.

(57) ABSTRACT

An egress system for an interior space such as an attic covered by roof decking. In one embodiment, the egress system comprises a steel frame adapted for installation within an opening formed in the roof decking between two adjacent roof joists. A hatch panel is releasably secured within the opening defined by the frame by means of a plurality of removable pins. In accordance with one aspect of the invention, an upper surface of the hatch panel is substantially flush with the upper surface of the roof decking, allowing for the uniform application of roofing material, such as composition shingles, overtop the roof decking and the hatch panel, thereby concealing the presence of the egress system beneath the roofing material. Deployment of the egress system is accomplished with the use of a cutting implement inserted from the underside of the egress system inside the interior space into a gap maintained around the periphery of the hatch panel when secured within said frame. The cutting implement cuts or perforates the roofing material sufficiently to permit at least partial release of the hatch panel from the frame, allowing egress from the interior space defined by the frame.

11 Claims, 6 Drawing Sheets

U.S. PATENT DOCUMENTS 6,151,848 A * 11/2000 Hunter ..... 52/205
6,363,670 B1 * 4/2002 Dewitt ..... 52/202
6,647,676 B1 * 11/2003 Hansen et al. ..... 52/200
6,658,803 B2 * 12/2003 Szyjkowski ..... 52/213
6,771,181 B1 * 8/2004 Hughen, Jr. ..... 340/693.5
6,966,157 B1 * 11/2005 Sandow ..... 52/200
7,028,431 B2 * 4/2006 Tlemcani et al. ..... 49/8
7,305,800 B1 * 12/2007 Calfee ..... 52/203
2002/0043033 A1 * 4/2002 Szyjkowski ..... 52/213
2002/0153751 A1 * 10/2002 Lenhardt et al. ..... 296/214
2004/0154244 A1 * 8/2004 Moffatt ..... 52/204.55
2005/0000173 A1 * 1/2005 Lindgren et al. ..... 52/200
2006/0272274 A1 * 12/2006 Burton et al. ..... 52/745.16
2007/0044401 A1 * 3/2007 Bonshor ..... 52/213
2008/0086959 A1 * 4/2008 McNelis ..... 52/202
2008/0110110 A1 * 5/2008 Burton et al. ..... 52/213

* cited by examiner

CONCEALED EMERGENCY ATTIC EGRESS SYSTEM

FIELD OF THE INVENTION

This invention relates generally to home safety, and, and more particularly relates to an emergency egress system for enclosed interior spaces such as attics and the like.

BACKGROUND OF THE INVENTION

In residential construction, it is common for a residential structure to include an attic space disposed above the uppermost living area and beneath the decking of the roof. Often, attic spaces are configured so as to not be conducive to everyday occupancy, but may be useable for storage of infrequently accessed items and/or utility equipment such as air conditioning units and the like.

To provide access to attic spaces from living areas below, there is commonly provided an access hole in the ceiling of the living space. In order to enter the attic space, a person in the living space must typically climb a ladder and move aside a panel or other means by which the access hole in the attic floor is normally sealed. Another common arrangement is the provision of "fold-down" or pull-down stairs in the attic floor opening. Countless examples of such attic stairs have been shown in the prior art.

Often, the opening in a residential attic floor is the only means of ingress to and egress from an attic space. This can pose a number of problems and/or dangers. For example, it is possible for a ladder by which a person has used to access the attic space to be inadvertently tipped or moved, making it impossible for those in the attic space to subsequently exit. Likewise, fold-down or pull-down attic stairs are prone to breakage or jamming, making attic egress impossible.

Moreover, the circumstances that may have caused a person or persons to access the attic space in the first place may preclude subsequent exiting of the attic space by the same means with which it was entered. For example, as has been shown by recent catastrophic flooding in the Louisiana, Mississippi, Texas, and Alabama regions, rapidly rising flood waters may force residents to seek the high ground of an attic space. Tragically, there have been many reports of drowning deaths resulting from residents fleeing to attic spaces to avoid rising flood waters, and being subsequently being unable to extricate themselves from the attic spaces. Residential fires have also been known to force residents to retreat to and be subsequently trapped in attic spaces.

Mechanisms do exist for providing roof access to a structure from within the structure itself. Horizontal hinged covers or doors are commonly used for roof scuttles, automatic fire vents, ceiling access doors, basement doors and the like. A conventional roof scuttle 10 is depicted in FIG. 1. Roof scuttles such as shown in FIG. 1 generally comprise a rectangular frame 12 which surrounds an opening to be covered with the frame 12 being coupled with a hinge mechanism 14 to a door 16 for motion of the door 16 between an open and a closed position. The conventional roof scuttle has a vertical sheet metal inner wall with an outwardly extending 90° horizontal nailing flange 18 at the bottom of the wall 12 which flange is nailed or otherwise secured to the roof deck 20. Roofing materials are then used to waterproof the outer wall of the frame 12 by rolling the roofing along the roof surface and then up the vertical walls of the frame 12 and securing the roofing material thereto. An exemplary prior art roofing scuttle is described in U.S. Pat. No. 6,672,020 to Cermola et al., entitled "Universal Roof Scuttle."

Roofing scuttles such as depicted in FIG. 1 are most often used in commercial structures, and are believed to have several disadvantages, particularly in the context of residential structures. First, conventional roof scuttles are unsightly and do not tend to blend in with surrounding roofing materials. Second, conventional roof scuttles project upward from the roof surface, and as such can be susceptible to being dislodged, especially in harsh weather conditions, such as hurricanes or tropical storms. Finally, conventional roof scuttles are prone to leakage at the interface between flange 18 and the roof surface.

Thus, is it believed that it would be desirable to provide an improved means of emergency egress from an attic space that does not suffer from the perceived deficiencies of the prior art.

SUMMARY OF THE INVENTION

In view of the foregoing, the present invention is directed to an emergency egress system for interior spaces such as attics and the like. In one embodiment of the invention, the egress system comprises a hatch panel that is releasably secured within a mounting frame. The mounting frame is adapted for installation in an opening formed in a roof over the interior space.

In accordance with one aspect of the invention, the hatch panel is made of a material the same or similar to material used for roof decking over which roofing materials are customarily applied. In one embodiment, for example, the roof decking and hatch panel are each made of plywood.

In accordance with another aspect of the invention, once the egress system is installed on a roof, the desired roofing material is applied. Advantageously, due to the composition of the hatch panel, the roofing material can be applied uniformly over the roof decking and the egress system, leaving little or no evidence of the existence of the egress system under the roofing material.

In accordance with another aspect of the invention, a gap is maintained between the mounting frame and the hatch panel when the hatch panel is releasably secured within the frame. When it becomes necessary to deploy the egress system, such as when a person or persons become trapped in the interior space, a cutting implement such as a handsaw is provided for insertion into the gap between the hatch panel and the mounting frame. The cutting implement, which may be, for example, a drywall saw or the like, can thus be used to cut away the roofing material around the periphery of the hatch panel.

Once the roofing material is cut away, hatch panel can be partially or completely released from the mounting frame, providing access to the roof on which the egress system is installed.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION OF A SPECIFIC EMBODIMENT OF THE INVENTION

In the disclosure that follows, in the interest of clarity, not all features of actual implementations are described. It will of course be appreciated that in the development of any such actual implementation, as in any such project, numerous engineering and technical decisions must be made to achieve the developers' specific goals and subgoals (e.g., compliance with system and technical constraints), which will vary from one implementation to another. Moreover, attention will necessarily be paid to proper engineering practices for the environment in question. It will be appreciated that such a development effort might be complex and time-consuming, but would nevertheless be a routine undertaking for those of ordinary skill in the relevant fields.

Figure 1:
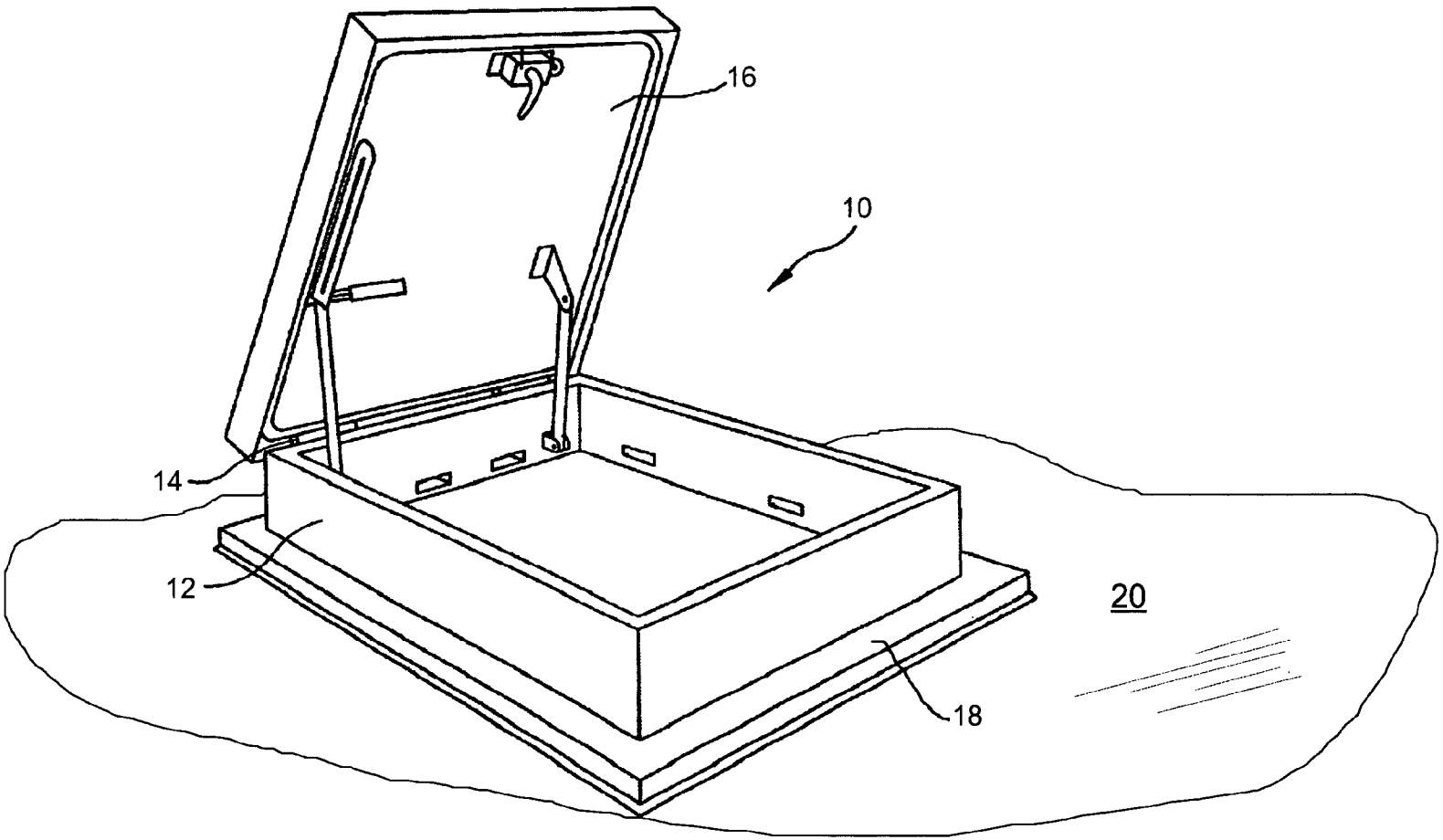
Figure 1 (PRIOR ART)
FIG. 1 is a perspective illustration of a prior art roof scuttle for providing roof access from the interior of a structure.
Figure 2:
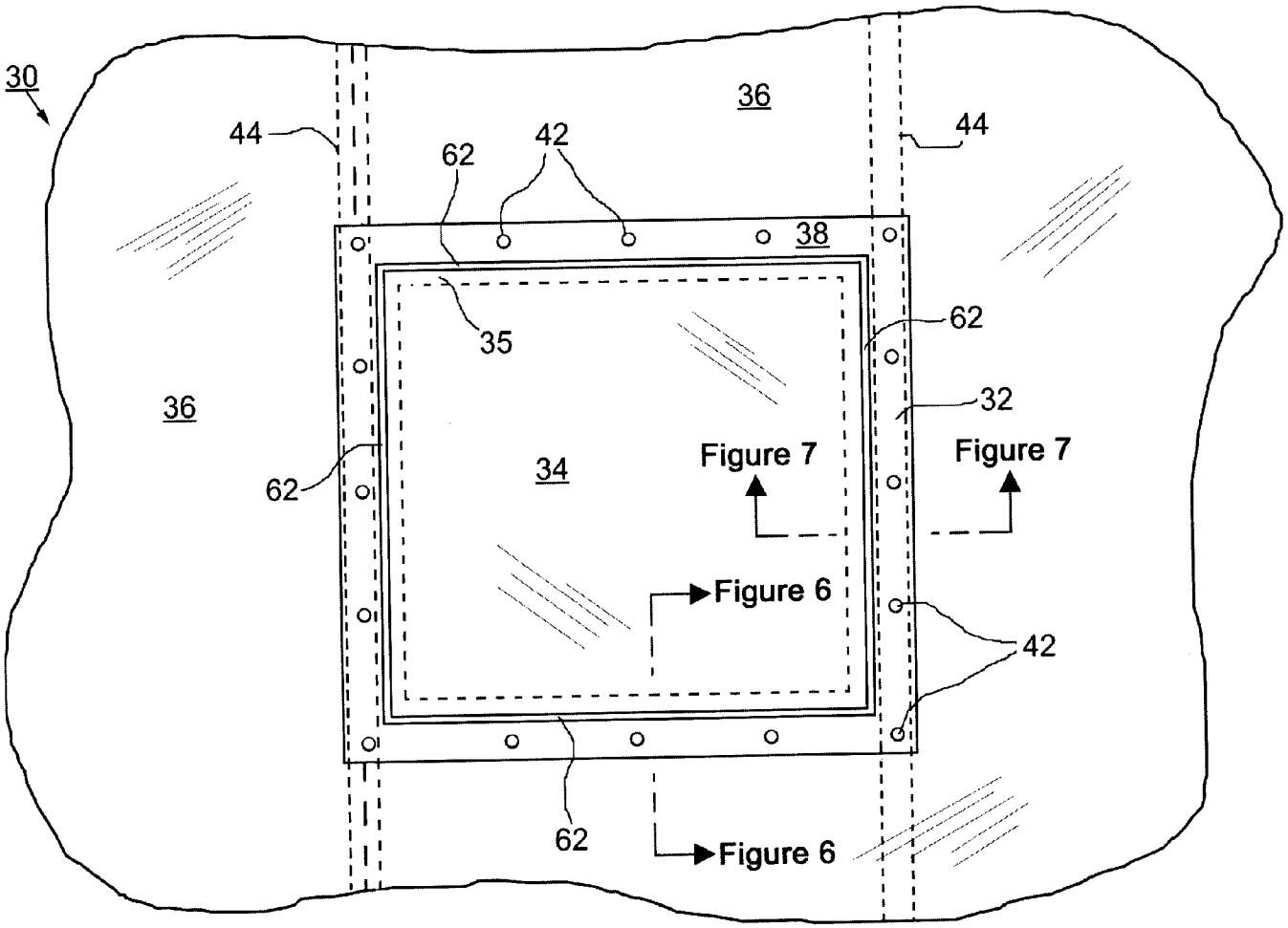
FIG. 2 is a top view of an emergency attic egress system in accordance with one embodiment of the invention.
Figure 3:
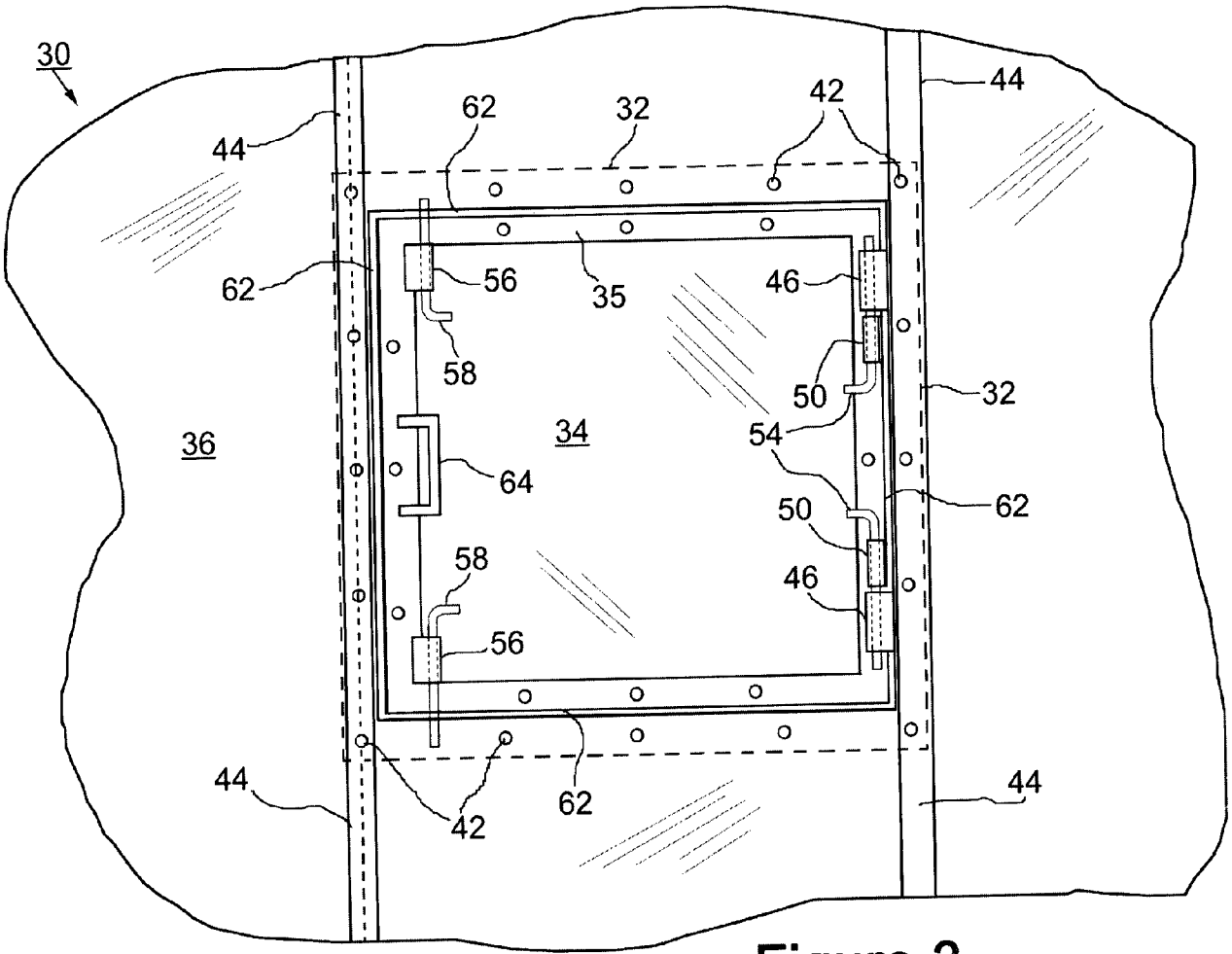
FIG. 3 is a bottom view of the egress system from FIG. 2.
Figure 4:
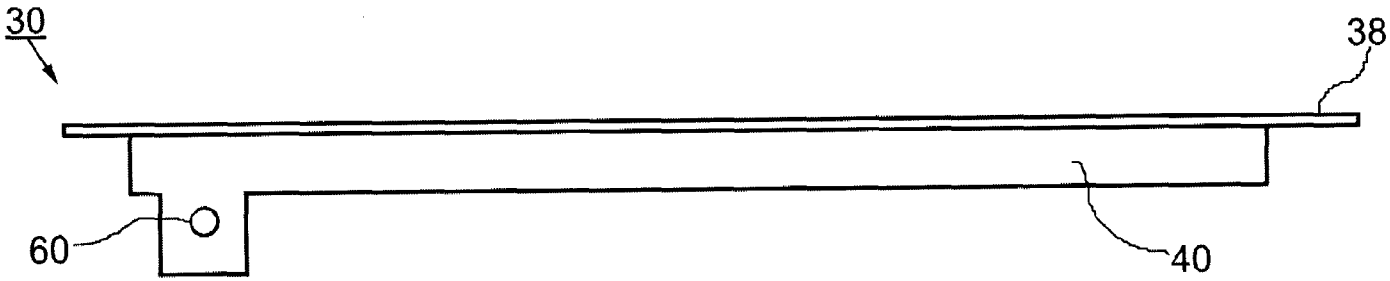
FIG. 4 is a side view of the egress system from FIG. 2.

Referring to FIGS. 2, 3, and 4, there are shown top, bottom, and side views, respectively, of an emergency egress system 30 in accordance with one embodiment of the invention. As shown in the Figures, egress system 30 comprises two principal components: an outer mounting frame 32 and a hatch panel 34 adapted to be releasably secured within the outer frame 32.

In accordance with one aspect of the invention, egress system 30 is adapted for installation within an opening formed in roof decking 36 covering an interior space such as an attic. In a typical installation, roof decking comprises plywood or the like, upon which a roofing system is applied, as will be discussed below in further detail.

Figure 5B:
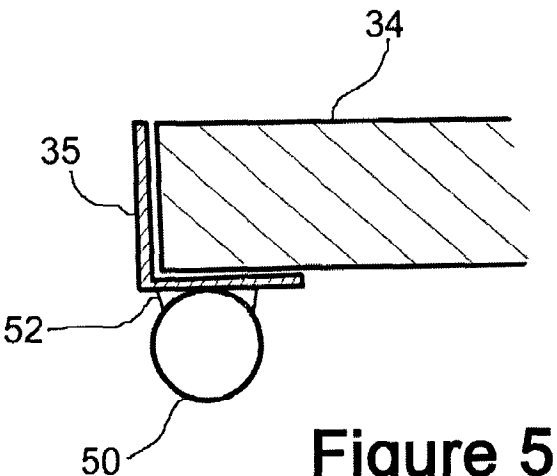
FIG. 5*b* is a side, cross-sectional view of a hatch panel from the egress system from FIG. 2.
Figure 5A:
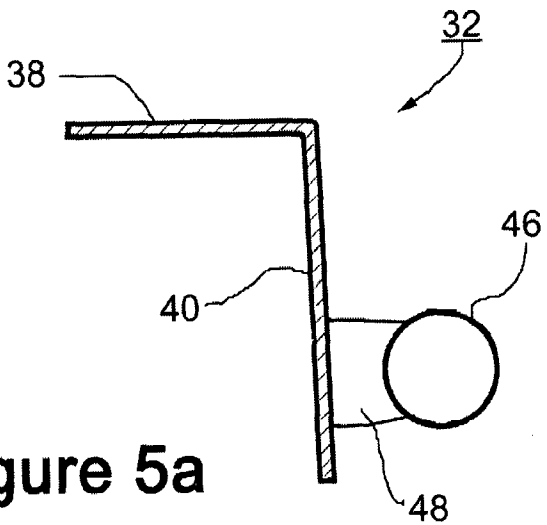
FIG. 5*a* is a side cross-sectional view of a mounting frame from the egress system from FIG. 2.

FIG. 5*a* is a side, cross-sectional view of frame 32. As shown in FIG. 5*a*, mounting frame 32 comprises a horizontal mounting portion 38 and an inwardly-extending flange portion 40, together defining a substantially right-angle cross-section of frame 32. In the presently preferred embodiment, frame 32 is made of ⅛$^{th}$ inch thick steel, and has a plurality of holes drilled therein to facilitate attachment of frame 32 to roof decking 36. (Several exemplary holes are designated with reference numeral 42 in the Figures).

FIG. 5*b* is a side, cross-sectional view of an edge of hatch panel 34. Hatch panel 34 is preferably made of a material the same as or similar to conventional roof decking, for example, ¾-inch CDX plywood. As shown in FIG. 5*b*, hatch panel 34 has a steel angle 35 affixed around the periphery thereof. In the presently disclosed embodiment, steel angle 35 is a ¾-inch by ¾-inch by ⅛-inch steel angle.

In the preferred embodiment, and with reference specifically to FIG. 3, frame 32 has dimensions that permits its installation between adjacent roof joists 44 in residential construction framing; that is, frame 32 is preferably between 16 and 24 inches in width, so as to be accommodated within the standard spacing between the roof joists 44 which support roof decking 36. Mounting portion 38 of frame 32 is adapted to be flush-mounted atop roof decking 36, with flange portion 40 of frame 32 extending inward toward the interior space covered by roof decking 36.

In the presently disclosed embodiment, and as shown especially in FIGS. 3 and 5, a plurality of cylindrical pin sockets 46 are disposed on the inner face of flange 40, i.e., facing into the opening defined by frame 32. In one embodiment, pin sockets 46 are affixed to flange 40 by welds 48 or another suitable affixing structure, as would be apparent to those of ordinary skill in the art. As shown in FIG. 3, pin sockets 46 are positioned so as to align coaxially with complementary pin sockets 50 affixed to the underside of hatch panel 34 along one edge thereof. Specifically, complementary pin sockets 50 are affixed to steel angle 35 by means of welds 52 or another suitable affixing structure. Thus arranged, sockets 46 and 50 cooperate to permit securing pins 54 to be inserted therein, thus securing one edge of hatch panel 34 in a hinge-like fashion to flange 40 of frame 32.

With reference to FIG. 3, on the opposite edge of hatch panel 34 from pin sockets 50 another pair of pin sockets 56 are affixed, as by welds or the like, to steel angle 35. Pin sockets 56 are positioned so as to permit insertion of a second pair of securing pins 58 therein. Securing pins 58 extend through sockets 56 and into holes 60 (see FIG. 5) formed in flange 40, thereby securing this edge of hatch panel 34 within frame 32.

In accordance with one aspect of the invention, when hatch panel 34 is fully secured within frame 32 by means of pins 54 and 58, there is a narrow gap 62 around the periphery of hatch panel 34 between the panel 34 and frame 32. Specifically, gap 62 is defined between angle steel 35 surrounding hatch panel 24 and the inner face of flange 40. In the presently preferred embodiment, gap 62 is approximately ⅛-inch wide, although those of ordinary skill in the art having the benefit of the present disclosure will appreciate that the width of gap 62 may be greater or less than ⅛-inch depending upon the cutting/perforating implement necessary to deploy system 10, as will hereinafter be described in greater detail.

Finally, with reference to FIG. 3, a metal handle 64 is welded or otherwise affixed to the underside of angle steel 35, to facilitate deployment of the egress system as shall hereinafter be described.

Figures 6, 8:
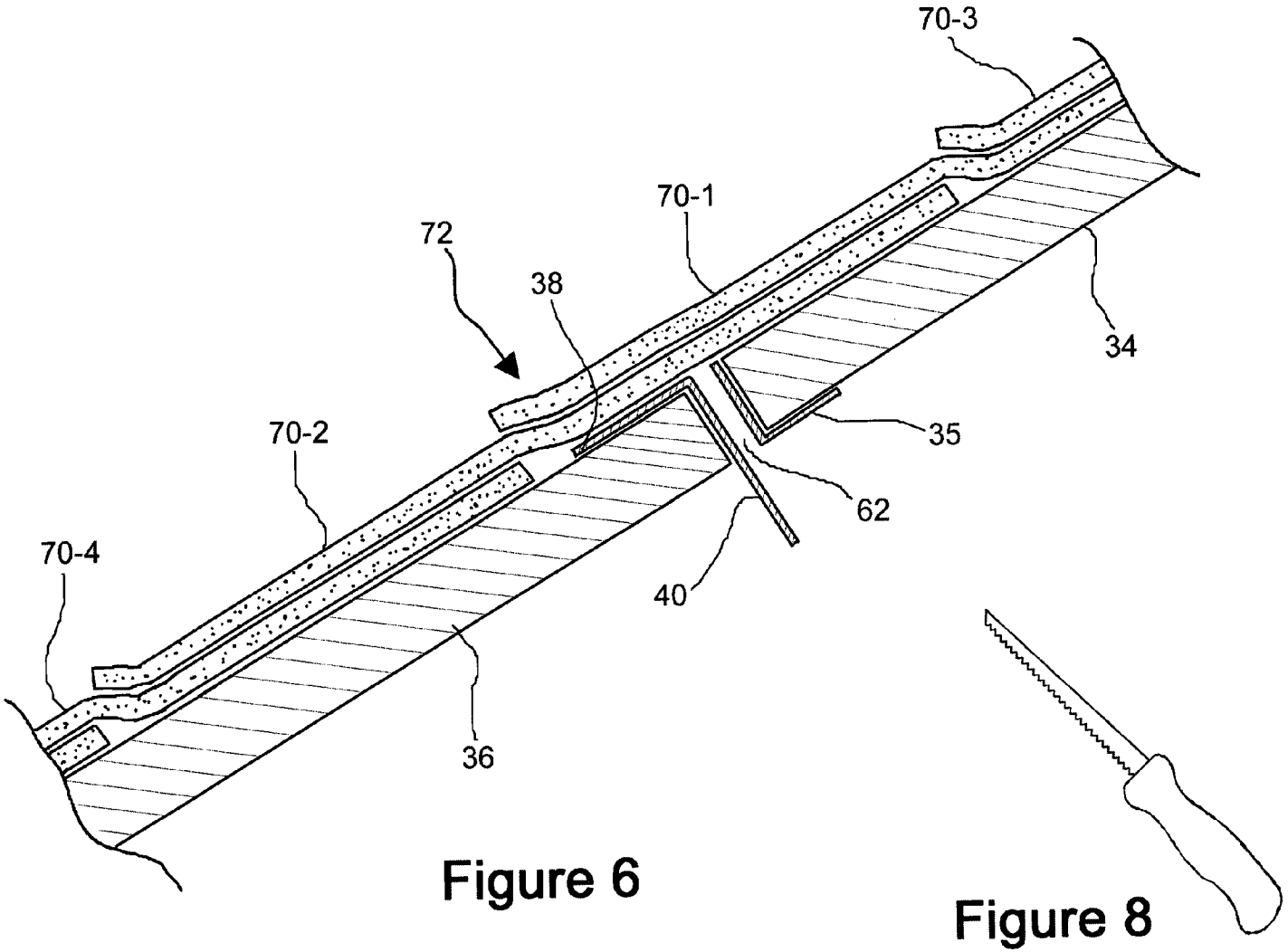
FIG. 6 is a side cross-sectional view of a bottom edge portion of the egress system from FIG. 2.
FIG. 8 is an illustration of a cutting implement for use in deploying the egress system from FIG. 2.
Figure 7:
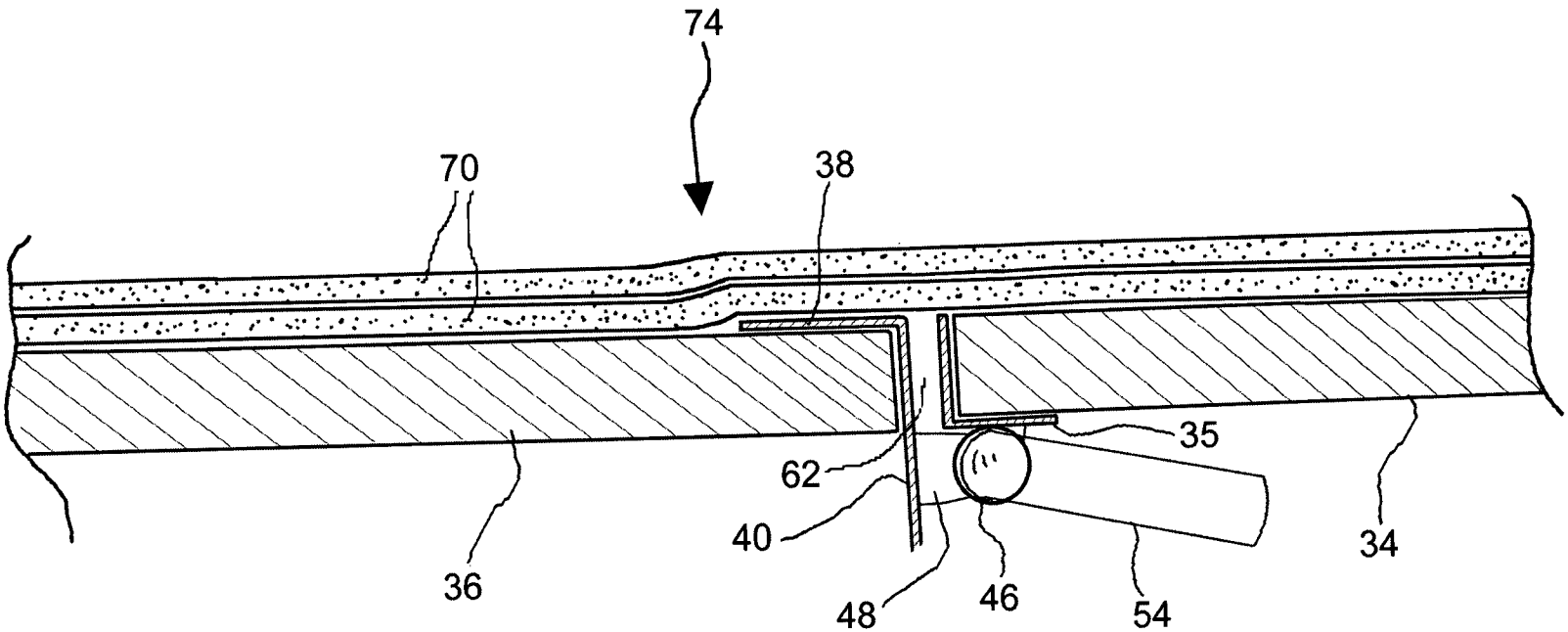
FIG. 7 is a side cross-sectional view of a side edge portion of the egress system from FIG. 2.

Turning now to FIGS. 6 and 7, there are shown cross-sectional views of egress system 10 along the bottom and side edges thereof, respectively, at locations as shown by the respective section indictors in FIG. 2. In the embodiment depicted in FIGS. 6 and 7, egress system 30 is shown after being installed in an opening in roof decking 36 and after having roofing material applied uniformly overtop of the roof decking 36 and the hatch panel 34.

In particular, in the exemplary embodiment of FIGS. 6 and 7, the invention is shown installed in a roof that is covered with conventional asphalt/composition shingles 70. Shingles 70 may be, for example of the conventional "three-tab" type installed in a conventional staggered (running bond), overlapping pattern overtop of the roof decking, as would be familiar to anyone of ordinary skill in the art. (Although not shown in the Figures, a layer of tar paper or other protective material may first be applied to roof decking 36 prior to installation of shingles 70, as would be appreciated by those of ordinary skill in the art.)

The overlapping pattern of shingles 70 can be seen in FIG. 6, where the bottom portion of a first shingle 70-1 overlaps the top portion of a second shingle 70-2. Similarly, a bottom portion of shingle 70-3 overlaps a top portion of shingle 70-1, and a bottom portion of shingle 70-2 overlaps a top portion of a shingle 70-4.

FIG. 6 shows a portion of egress system 30 along a bottom edge thereof. Mounting portion 38 of frame 32 is affixed, for example, with roofing nails, screws or the like extending through holes 42, to roof decking 36. Flange portion 40 of frame 32 extends downwardly through and opening in roof decking 36 to define one side of gap 62. As would be known to those of ordinary skill in the art, roofing shingles are customarily nailed to roof decking with roofing nails driven through the shingles along the top edge thereof. Thus, in the example installation of FIG. 6, shingle 70-4 would be nailed onto the portion of roof decking 36 shown in FIG. 6.

As previously noted, and in accordance with an important aspect of the invention, hatch panel 34 is preferably made of the same or similar material, such as CDX plywood or the like, as roof decking 36. Note from FIG. 6 that the arrangement of cylindrical pin sockets 46 on frame 32, cylindrical pin sockets 50 and 58 on steel angle 35 around roof hatch 34, and holes 60 in frame 32 is such that the top surface of hatch panel 34 is substantially flush with the top surface of mounting portion 38 of frame 32. Angle steel 35 around the edge of hatch panel 34 defines an opposing side of gap 62 between frame 32 and hatch panel 34.

Because hatch panel 34 is made of material suitable for application of roofing materials using conventional techniques, applying roofing to a roof equipped with the egress system 30 in accordance with the present invention, or retrofitting an existing roof to equip it with an egress system 30 can be accomplished with little or additional effort as compared with application of roofing material to a roof not equipped with egress system 30. More importantly, the presence of egress system 30 is virtually undetectable once the roofing material is completely applied. That is, roof decking 36 and hatch panel 34 cooperate to define a surface upon which roofing material can be applied uniformly, with little or no discernable external indication of the interface between roof decking 36 and egress system 30.

In particular, as can be observed in FIG. 6, there may be at most only an extremely slight deformation in shingles 70-1 and 70-2 in the area generally designated with reference numeral 72, where those shingles pass over mounting portion 38 of frame 32. This slight deformation, if any, resulting from the conformal nature of the composition of shingles 70, is not readily apparent to the casual observer. (And, as is apparent in FIG. 6, may be non-existent depending upon the location of shingles 70-1 and 70-2 relative to mounting portion 38). For example, in a typical embodiment using conventional asphalt/composite shingles and where frame 32 is made of $1/8^{th}$ inch thick steel, the deformation in region 72 can be expected to be no more than $1/8^{th}$ of an inch. (It is to be noted that FIGS. 6 and 7 are not drawn to scale, and that any deformation of shingles 70 observable in those Figures is exaggerated for the purposes of clarity of description.) In any event, any deformation of roofing material at the interface between roof decking 36 and egress system 30 will be substantially less than the thickness of the roofing material itself. For more rigid roofing materials, such as slate, cedar, and the like, there will be essentially no perceptible variation in the appearance of the roofing material as a result of installation of egress system 30.

FIG. 7 shows the cross-sectional view of a side portion of egress system 30 as shown with the section indicators in FIG. 2. In addition to frame 32 and angle steel 35 defining gap 62, observable in FIG. 7 is a cylindrical pin socket 46 through which securing pin 54 is inserted. Once again, slight deformations of the shingles 70 may form at region 74 where shingles 70 pass over mounting portion 38 of frame 32, but this deformation, if any, will be minimal.

In accordance with one aspect of the invention, a cutting implement 78, such as a conventional handheld drywall saw as is depicted in FIG. 8, is used for the purposes of deploying egress system 30. Preferably, cutting implement 78 is secured to the underside of hatch panel 34, by means of a clip, tether, or the like, such that it is always available in the event of an emergency.

In the event of an emergency or other circumstance in which a person in an attic in which the system 30 is installed must exit the attic by means other that that used to enter, the person can deploy the system 30. The first step in deploying system 30 to insert cutting implement 78 gap 62 and cut through, or at least perforate, the overlying roofing material, (shingles 70 in the disclosed embodiment) around the periphery of hatch panel 34. Next, some or all of pins 54 and 58 are removed, to permit the partial or complete release of hatch panel 34 from frame 32.

If only pins 58 are removed, for example, the user can grasp handle 64 and pull hatch panel downwardly into the attic space. During this process, sockets 46 and 50 and pins 54 cooperatively act as a hinge along one edge of hatch panel 34, preventing panel 34 from falling in on the user. Once panel 34 has been pulled all the way down, the user can climb to safety through the opening defined by frame 32. As noted, pins 54 can also be removed to permit the total release of hatch panel 34 from frame 32.

At least one refinement or additional feature of system 30 is contemplated. In particular, in one embodiment, the upper surface of hatch panel 34 is preferably painted a bright, distinctive color, such as red. After system 30 has been deployed, the user can remove the shingles applied to hatch panel 34 to expose the bright upper surface thereof. If hatch panel 34 is then subsequently raised back to its closed position, the bright appearance of the hatch panel will be more readily visible to rescue personnel, who will thus be alerted to the presence of the system 30 and given some indication that a person or persons may be in need of assistance.

The underside surface of hatch panel 34 may similarly be painted a bright, distinctive color, in order to enhance its visibility to any person who might become trapped in an attic in which it is installed.

From the foregoing description of specific embodiments of the invention, it should be apparent that an egress system for an interior space has been disclosed that can be installed in a manner which in inobtrusive and which does not interfere with the application of roofing materials on outer surfaces of roof decking covering the interior space has been disclosed. Although specific embodiments have been described herein in some detail, this has been done solely for the purposes of illustrating the various advantageous aspects and features of the invention, and is not to be construed as limiting the scope of the invention as defined by the claims which follow.

It is contemplated that various alterations, substitutions, and/or modifications, including but not limited to the implementation variants and options specifically noted in this disclosure, may be made to the disclosed embodiments of the invention without departing from the spirit and scope of the invention as defined in the claims.

For example, the exemplary embodiment disclosed herein involved the use of asphalt/composition roofing shingles as the roofing material applied uniformly over the roof decking 36 and hatch panel 34. However, it is contemplated that the invention admits to practice in conjunction with a variety of alternative roofing materials, including, without limitation, tar-and-gravel roofing, membrane roofing, wooden (e.g., cedar) shingling, and even slate or other tile roofing materials. It will be appreciated by those of ordinary skill in the art having the benefit of the present disclosure that the type of cutting implement utilized in a particular case may be different depending upon the type of roofing material applied overtop the roof decking 36 and hatch panel 34. For example, in the case of slate or tile roofing, a hammer and chisel combination may be utilized to cut or perforate the roofing material via gap 62. It is believed that those of ordinary skill in the art having the benefit of this disclosure would be readily able to identify the type of cutting/perforating implement suitable for a given application.

What is claimed is:

1. An egress system for an interior space covered by roof decking comprising:

a first metal frame defining an opening, said frame having a substantially right-angle cross section defining a support portion and a flange portion, said support portion adapted to be flush-mounted on a top surface of said roof decking, said flange portion extending inwardly through an opening formed in said roof decking towards said interior space;

a hatch comprising a second metal frame in surrounding relationship to a rigid panel, said panel having a first surface and a second surface and a peripheral edge and comprising a material similar to conventional roof decking, said second frame having a substantially right-angle cross section and having a first leg overlaying said peripheral edge, and a second leg overlaying a portion of said second surface of said panel adjacent said peripheral edge, said second surface of said panel facing towards said interior space, said flange portion being in surrounding relationship to said first leg, there being a gap between said flange portion and said first leg; and a releasable securing means holding said hatch in said frame defining said opening;

said roof decking and said first surface of said hatch having roofing material applied uniformly on an upper surface of said decking and said top surface of said hatch, respectively, said roofing material overlying the gap.

2. An egress system in accordance with claim 1, further comprising:

a cutting implement, adapted to be inserted into said gap from an underside of said egress system to permit perforation of said roofing material around said periphery of said hatch panel, thereby facilitating at least partial release of said hatch panel from said frame.

3. An egress system in accordance with claim 2, wherein said cutting implement comprises a handheld saw.

4. An egress system in accordance with claim 1, wherein said opening is formed between adjacent joists supporting said roof decking.

5. An egress system in accordance with claim 1, wherein said roof decking is supported by a plurality of roof joists, and wherein said egress system is disposed between two adjacent roof joists.

6. An egress system in accordance with claim 1, wherein said upper surface of said hatch panel is substantially flush with said upper surface of said roof decking when said hatch panel is secured in said frame.

7. An egress system in accordance with claim 1, wherein said roof decking is plywood.

8. An egress system in accordance with claim 7, wherein said hatch panel is plywood.

9. An egress system in accordance with claim 1, wherein said frame is made of steel.

10. An egress system in accordance with claim 1, wherein said roofing material comprises composition shingles.

11. An egress system in accordance with claim 1, wherein said releasable securing means comprises at least one removable pin inserted in a first socket attached to said flange and a second socket attached to said second frame.

* * * * *